US007721582B2

(12) United States Patent
Speck

(10) Patent No.: US 7,721,582 B2
(45) Date of Patent: May 25, 2010

(54) BENDING MACHINE FOR ROD-SHAPED WORKPIECES MADE FROM WIRE, TUBULAR MATERIAL OR THE LIKE

(75) Inventor: Norbert Speck, Reutlingen (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 636 days.

(21) Appl. No.: 11/784,576

(22) Filed: Apr. 6, 2007

(65) Prior Publication Data

US 2007/0234775 A1 Oct. 11, 2007

(30) Foreign Application Priority Data

Apr. 7, 2006 (EP) ..... 06007400

(51) Int. Cl.
*B21D 11/00* (2006.01)

(52) U.S. Cl. ..... 72/306; 72/305; 72/311

(58) Field of Classification Search ..... 72/295, 72/296, 298, 301, 305, 306, 307, 311, 369, 72/419, 420

See application file for complete search history.

(56) References Cited

U.S. PATENT DOCUMENTS

| | | | | |
|---|---|---|---|---|
| 3,410,125 | A | 11/1968 | Schmidt | |
| 4,380,920 | A | 4/1983 | Coop, Sr. et al. | |
| 4,597,279 | A * | 7/1986 | Lisec | 72/306 |
| 4,945,747 | A | 8/1990 | Yogo | |
| 5,222,552 | A | 6/1993 | Schuchert | |
| 5,495,740 | A | 3/1996 | Schwarze | |
| 5,819,574 | A | 10/1998 | Yogo | |
| 5,852,945 | A | 12/1998 | Burger | |
| 6,185,968 | B1 * | 2/2001 | Kanamori | 72/306 |
| 7,140,224 | B2 | 11/2006 | Luo et al. | |

FOREIGN PATENT DOCUMENTS

| | | | |
|---|---|---|---|
| DE | 39 22 326 | C2 | 11/1990 |
| DE | 43 00 311 | C2 | 7/1994 |
| DE | 196 30 023 | A1 | 1/1998 |
| DE | 201 18 444 | U1 | 3/2002 |
| DE | 696 24 723 | T2 | 3/2003 |
| DE | 20 2001 011 947 | U1 | 10/2004 |
| EP | 1 065 015 | A1 | 1/2001 |
| EP | 0 852 522 | B1 | 6/2002 |
| GB | 943918 | | 12/1963 |

* cited by examiner

*Primary Examiner*—Dana Ross
*Assistant Examiner*—Teresa M Bonk
(74) *Attorney, Agent, or Firm*—Patterson, Thuente, Christensen, Pedersen, P.A.

(57) ABSTRACT

In a bending machine for bending rod-shaped workpieces made from wire, tubular material or the like, a machine frame is provided with at least one bending station including two bending units. Each of said bending units includes a bending head with a bending head housing and a bending tool, an auxiliary gripper arranged on the bending head housing so as to be pivotable perpendicular to the longitudinal axis of the machine frame, and a gripping unit, which is spaced apart from the bending head as viewed along the longitudinal axis of the frame, pivotable perpendicular to the longitudinal axis of the machine frame and displaceable on a guide in the direction of said axis. The two bending heads of each bending station are arranged next to each other with their auxiliary grippers facing each other and are positioned between the two gripping units such that each bending head- viewed in the direction of the frame's longitudinal axis—is mounted between the other bending head and the gripping unit associated with the other bending head.

22 Claims, 6 Drawing Sheets

BENDING MACHINE FOR ROD-SHAPED WORKPIECES MADE FROM WIRE, TUBULAR MATERIAL OR THE LIKE

RELATED APPLICATION

The current application claims the benefit of priority to European Patent Application No. 06 007 400.2 filed on Apr. 7, 2006. Said application is incorporated by reference herein.

FIELD OF THE INVENTION

The invention relates to a bending machine for rod-shaped workpieces made from wire, tubular material or the like.

BACKGROUND OF THE INVENTION

In the prior art, different bending machines for bilateral processing of workpieces cut to length are known.

DE 3922326 C2 describes a bending machine comprising two bending heads mounted to robot arms, wherein up to four axes of rotation are present for positioning the tool on the workpiece. Each robot arm has its own guide assigned to it, allowing said robot arm to be displaced parallel to the workpiece. Between the guideways of the robot arms, a gripping unit is provided for fixing the respective workpiece to be processed, which gripping unit can be lowered, in which case a bending tool then functions as gripping means. The use of bending robots for bending the workpiece to be shaped is very complex, so that due to the workpiece to be processed being held only at its center or even only due to the fixation of the workpiece when lowering it, undesired vibrations may occur at the bending tool in the longitudinal direction of the workpiece, which has an unfavorable influence both on the bending accuracy as well as on the possible speed of the bending operations and, thus, on the performance of the machine.

A bending device is known from DE 4300311 C2, which bending device comprises one or more gripping units that can be displaced in one plane, said gripping units transporting the workpiece to be processed between parallel bending stations, each of said bending stations carrying out one single bending operation. During bending itself, the tool is fixed by the clamps of the bending tool of the respective bending station. In this case, the bending heads are fitted on a vertically displaceable table so as to enable transport of the workpieces without vertically moving the gripping units. This known machine is very complex in terms of its overall structure and does not allow the processing of wire directly from the coil.

DE 19630023 A1 describes a bending system comprising a plurality of bending stations in which a workpiece can be processed first on one side and then on the other or, in the case of bending in one plane, on both sides at the same time. In this case, a plurality of gripping units are provided to convey the workpiece between the individual bending stations, which grippers are also used to rotate the workpieces. The bending heads are arranged for displacement parallel to the workpiece axis. All gripping units are mounted to a portal. This known bending machine also has a very complex structure, which applies particularly to the arrangement of the gripping units on a portal construction. This known bending machine also does not enable processing of wire drawn directly from the coil.

The bending machine known from DE 20 2004 011 947 U1 also serves to process elongated workpieces in a plurality of stations. In this case, each station comprises a central gripping unit and two bending heads mounted laterally thereof, which are displaceable on a common bed guide as is the gripping unit. In addition, a pivotable transfer device is provided by which the workpiece can be pivoted from the first processing station to the second, parallel processing station. The transfer device may be the gripping unit at the same time. This known machine works serially from out of a magazine and likewise does not allow the processing of wire directly from the coil.

SUMMARY OF THE INVENTION

In view of the above, it is an object of certain embodiments of the invention to propose a new bending machine of the above-mentioned type, which is also suitable to process wire from a coil, has a comparatively simple structure, is particularly flexible in use and allows a high production capacity.

According to certain embodiments of the invention, this object is achieved by a bending machine for rod-shaped workpieces made from wire, tubular material or the like, wherein a machine frame is provided with at least one bending station thereon comprising two bending units, each of said bending units comprising a bending head with a bending head housing and with a bending tool as well as an auxiliary gripper arranged on the bending head housing so as to be pivotable perpendicular to the longitudinal axis of the frame and an associated gripping unit which is spaced apart from the bending head, as viewed along the longitudinal axis of the frame, is pivotable perpendicular to the longitudinal axis of the frame and is displaceable on a guide in the direction of said axis. Further, the two bending heads of each bending station are arranged adjacent to each other with their auxiliary grippers facing each other and are positioned between the two gripping units such that each bending head—viewed in the direction of the frame's longitudinal axis—is mounted between the other bending head and its associated gripping unit.

The bending machine according to certain embodiments of the invention is very flexibly usable, because it permits not only the processing of rod-shaped workpieces from out of a magazine, but also the processing of material from a coil. The arrangement of one bending station with two bending units according to certain embodiments of the invention allows both ends or sides of a cut-to-length workpiece to be bent one after the other into a desired shape in a bending station. The arrangement of at least two bending stations (that is, one on either side of the machine frame), each comprising a pair of bending heads mounted thereto with an associated gripping unit, makes it possible to simultaneously process as many as four workpieces in different stations, which is a considerable improvement in efficiency, with each workpiece cut to length being processed in an alternating manner in the first and then in the second bending unit of the respective bending station. Since each bending unit fixes the respective workpiece itself, it is possible that, after processing of the workpiece in the first bending unit and transfer to the second bending unit of the same bending station, a new workpiece can be received and processed again in the other bending station at the same time as and parallel to the processing of the transferred workpiece.

The fact that, due to their pivotability perpendicular to the longitudinal axis of the frame in certain embodiments, the gripping units of each bending station seize the workpieces in an orientation parallel to said axis allows the workpieces to be supplied centrally in the longitudinal direction of the frame (and oriented along said axis) between the bending stations arranged on both sides of the machine frame. This allows the feeding, straightening and separation of the wire from the coil to be effected by a preceding unit, with the workpiece that has been cut to length being present immediately after cutting in a position suitable for seizing between the bending stations.

However, the bending machine according to certain embodiments of the invention may also be operated without such a feeding and straightening unit as well as without such a cutting unit, in which case workpieces already cut to length would have to be provided in a magazine, e.g. laterally of the machine frame. The arrangement of the bending stations with their bending units also allows the bending machine according to the invention to seize the individually provided workpieces from the magazine and to transfer them into the respective bending unit without any problem.

Similarly, it is also possible, for workpieces having the same shape to be manufactured on one side of the bending machine in the respective bending station, and for other workpieces having a different shape (for example, also having a different length) to be manufactured on the other side of the frame so that simultaneous processing of different workpieces is possible using the bending machine according certain embodiments of the invention.

A further increase in the flexibility of use of the bending machine according to certain embodiments of the invention can also be achieved if two or even more bending stations are arranged on either side of the frame's longitudinal axis, in which case, for example, the same workpieces can be processed at all the bending stations of the respective bending machine, thus further increasing the production capacity of the machine. However, it would also be conceivable to bend in each bending station of such a bending machine a workpiece that is to have a different shape, so that even simultaneous bending of a plurality of different workpieces could take place.

Of course, in certain embodiments each of the two gripping units of a bending station can have its own guide mounted to the bending machine according to the invention. However, it is particularly preferred if both gripping units of a bending station are displaceable along the same guide.

The guide of the gripping units may be provided in any suitable manner. In particularly preferred embodiments, however, each guide for the gripping units of a bending station consists of two guideways, in particular two guide rails, which are parallel to each other as well as to the frame's longitudinal axis on the machine frame. If more than one bending station is provided on either side of the machine frame in a bending machine according to an embodiment of the invention, it is particularly preferred for all gripping units of all bending stations on the same side of the bending machine to be able to be displaced along the same guide rails on the machine frame. This provides for not only a simplification of the overall structure, but particularly also a precise alignment of the adjusting directions of the gripping units of a bending station relative to one another.

In a bending machine according to certain embodiments of the invention, each auxiliary gripper advantageously comprises a supporting arm which is pivotably supported directly on the side of the bending head housing of the associated bending head, said supporting arm again preferably comprising, at its protruding end, a gripping arrangement that is radially displaceable with respect to its pivoting axis and is provided with two clamps for seizing the rod-shaped workpiece to be fed to the bending tool for bending. This results in a relatively simply structured, but very efficient overall constructive arrangement for the auxiliary gripper.

It is further advantageous if each gripping unit in the bending machine according to certain embodiments of the invention also comprises a pivotable lever arm which carries at its end region facing away from its pivoting axis a gripping arm that is in turn mounted so as to be pivotable about a further pivoting axis and comprises two gripping arrangements spaced apart from each other in the longitudinal direction of the frame's longitudinal axis for seizing a rod-shaped workpiece. In this case, the pivoting axes of the lever and gripping arms of each gripping unit are preferably parallel to one another. This also results in a relatively simple construction of the individual gripping unit.

Each gripping unit is preferably accommodated, with its associated drives, on a holding plate which is in turn displaceably fitted on the guide rails of the machine frame.

A further embodiment of the bending machine according to the invention also provides that, although each bending head housing is securely attached to the machine frame, the bending tool is displaceable, in the direction of its axis of rotation, relative to the bending head housing.

In a bending machine according to certain embodiments of the invention, the machine frame is advantageously provided, at its upper portion to which the bending stations are attached, with a machine bed that is substantially an isosceles trapezoid in cross-section, with the bending stations on both sides of the frame's longitudinal axis respectively being mounted to the oblique sides of the machine bed. This provides a particularly advantageous overall arrangement which is also relatively space-saving and, at the same time, allows easy and unhindered access to the individual elements of the bending stations.

The holding plates with the gripping units fitted thereon may be displaced along the guide rails in any suitable manner. However, it is particularly preferred if the gripping units are each displaceable along the guides via a rack-and-pinion drive, in which case the use of a single rack over the entire length of the guides on one side of the frame is sufficient to displace all holding plates with their gripping units.

Moreover, it is particularly preferred that in the bending machine both the bending heads with the auxiliary grippers and also the gripping units in a bending station are structurally identical.

It is similarly advantageous also if respective pairs of bending stations arranged opposite each other with respect to the frame's longitudinal axis are identical in design.

BRIEF DESCRIPTION OF THE DRAWINGS

The invention will be explained in more detail below, principally by way of example, with reference to the drawings, wherein.

DETAILED DESCRIPTION

Figure 1:
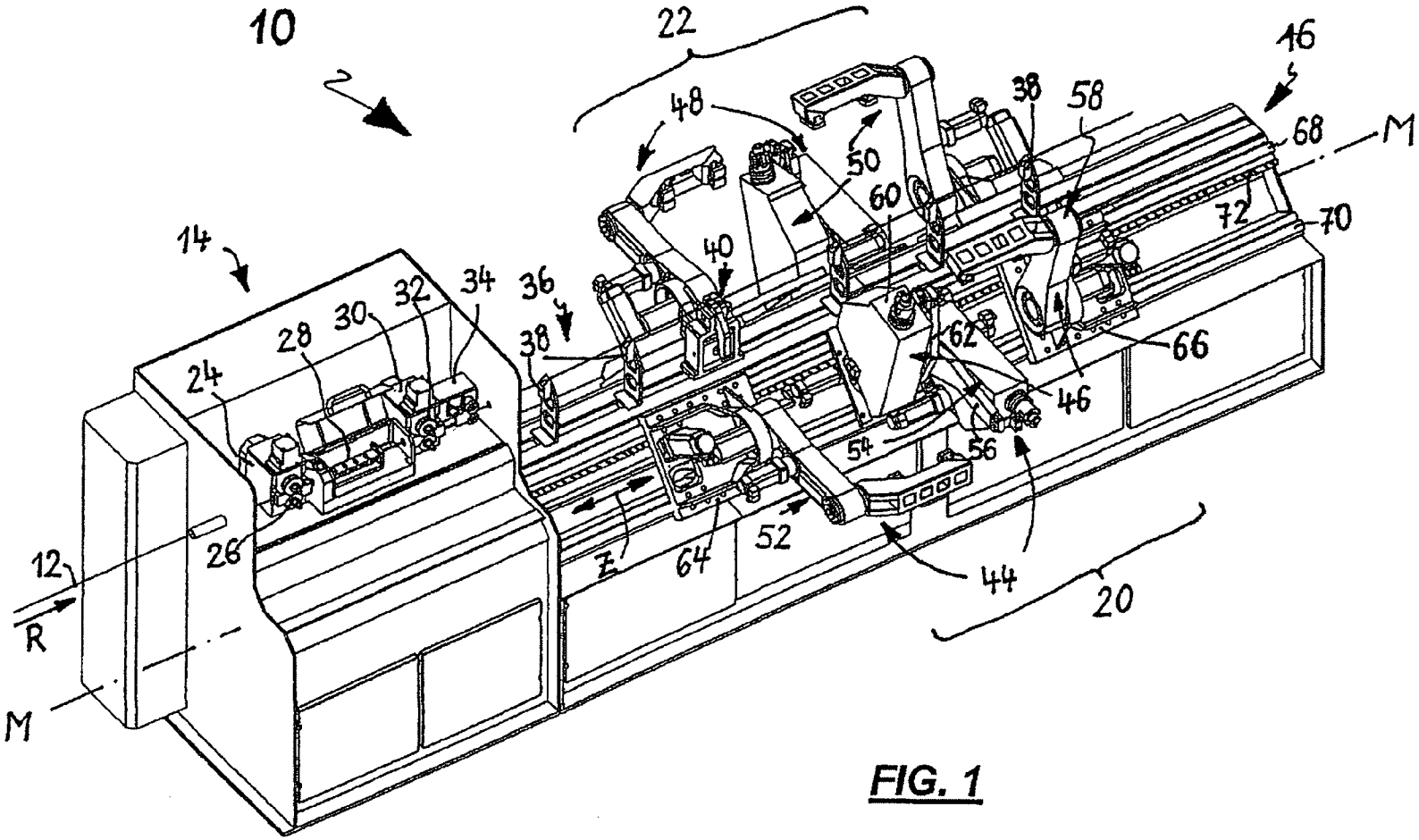
FIG. 1 shows a perspective view (an oblique frontal top view) of a bending machine according to an embodiment of the invention with a preceding feeding and straightening unit as well as with cutting and guiding units.

FIG. 1 shows a bending machine 10 for processing wire 12 from a coil according to an embodiment of the present invention. On the wire input side, the bending machine 10 is provided with an infeed and straightening unit 14, following which there is arranged a machine frame 16 comprising at its upper region a machine bed 18 whose cross-section is substantially an isosceles trapezoid, as is well-recognizable particularly from the (only schematically drawn) representation of the machine frame 16 in the end view of the bending machine 10 in FIG. 3.

The bending machine 10 has a longitudinal frame axis M-M, with a first bending station 20 (located at the front in the representation of FIG. 1) and a second bending station 22 (located at the rear in the representation of FIG. 1) being mounted to the machine bed 18 opposite each other on both sides of the frame's longitudinal axis M-M.

Reference is made first to the infeed and straightening unit 14, which comprises at least one infeed module 24 including a pair of infeed rollers 26 for feeding wire 12 from a coil (not shown). In addition, a straightening module 28 is provided, which may consist of a conventional rotating straightening body or also of a straightening apparatus with rollers and which straightens the wire 12 by bending in all planes.

Arranged following the straightening module 28 are a further infeed module 30, comprising a pair of infeed rollers 32, and a length-measuring unit 34, the latter being engageable with the wire 12 so as to determine the exact feed length.

After the infeed and straightening unit 14, the wire 12 passes through a cutting and guiding unit 36, with the wire being supported over its entire length by a plurality of guide elements 38 spaced apart on the machine bed 18 in the longitudinal direction of the frame.

At a suitable location between these guide elements, namely following the second guide element 38 (as viewed in the feed direction R of the wire 12) after the output point of the wire from the infeed and straightening unit 14 in the depicted bending machine 10, a cutting module 40 is mounted to the machine bed 18 such that it cuts off the wire 12 after a corresponding infeed length and thereby produces an elongated workpiece 42 cut to length as the initial workpiece for the subsequent bending operations. The position of the cutting module 40 is suitably selected at a site which is located in front of the entrance of the cut-to-length workpiece 42 between the bending stations 20 and 22 so that the workpiece 42 is easily seized there directly by a gripping unit of a subsequently arranged bending unit of a bending station 20 or 22, respectively, after the cutting operation and without further transport in the longitudinal direction of the frame and can then be transferred to one of the bending stations 20 or 22, respectively.

In the bending machine 10 of FIG. 1, the first bending station 20 and the second bending station 22 have an identical design, so that only the first bending station 20 (namely the bending station which is at the front, i.e. facing the viewer, in FIG. 1) will be described in more detail, because its description likewise applies to the second bending station 22 as well.

The first bending station 20 comprises two bending units 44 and 46 and the opposite second bending station 22 comprises two bending units 48 and 50.

The first bending unit 44 of the bending station 20 comprises a gripping unit 52 and a bending head unit 54 with an auxiliary gripper 56 mounted thereto and pivotable in a plane perpendicular to the frame's longitudinal axis M-M.

The other bending unit 46 of the bending station 20 in turn also comprises a gripping unit 58, a bending head unit 60 and an auxiliary gripper 62 mounted to the latter and pivotable in a plane perpendicular to the frame's longitudinal axis M-M.

Each of the two gripping units 52 and 58, respectively, is fitted on a holding plate 64 or 66, respectively. Both holding plates 64, 66 are displaceable on a guide extending in the frame's longitudinal direction M-M on the machine bed 18 (in the direction Z in FIG. 1 and FIG. 6), said guide consisting of two guideways in the form of suitably provided guide rails 68, 70 that are parallel to one another as well as to the frame's longitudinal axis M-M.

The displacement of the holding plates 64, 66 is effected along the guide rails 68, 70 via a toothed rack 72, in a motor-driven manner and parallel to the workpiece 42 cut to length.

The two bending head units 54 and 60, whose construction is shown in detail in the enlarged representation of FIG. 6 (which will be discussed in detail below), are in turn securely attached to the pair of guide rails 68, 70 and are not displaceable relative to the latter. As shown in detail in FIG. 6, only the two auxiliary grippers 56 and 62 are laterally mounted to the bending head housing 84 in a pivotable manner (in the pivoting direction T within a pivoting plane perpendicular to the frame's longitudinal axis M-M).

The gripping unit 52 on the holding plate 64 cooperates with the bending head unit 54 and its laterally associated auxiliary gripper 56 in connection with the first bending unit 44, while the other gripping unit 58 cooperates with the bending head unit 60 and its laterally mounted auxiliary gripper 62 in connection with the second bending unit 46.

In analogy, this also applies to the second bending station 22 arranged opposite the first bending station 20 and to the bending units 48 and 50 comprised by the former.

Figure 2:
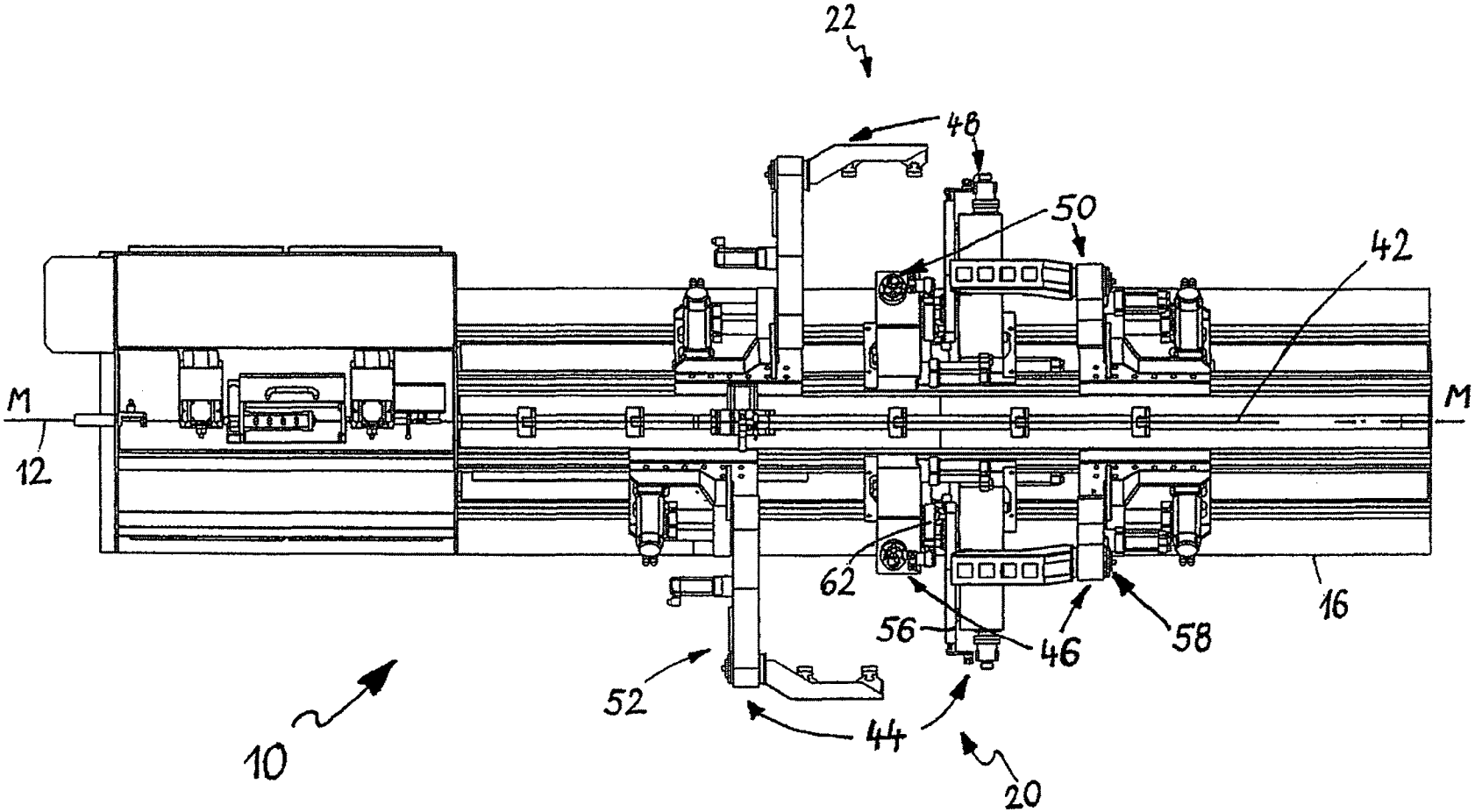
FIG. 2 shows a top view of the bending machine of FIG. 1.

The top view shown in FIG. 2 of the bending machine 10 according to FIG. 1 again clearly depicts the arrangement of the bending stations 20 and 22 effected on both sides of the frame's longitudinal axis M-M (which coincides with the orientation of the fed wire 12 in the top view) and their respective two bending units 44, 46 (bending station 20) and 48, 50 (bending station 22).

Figure 3:
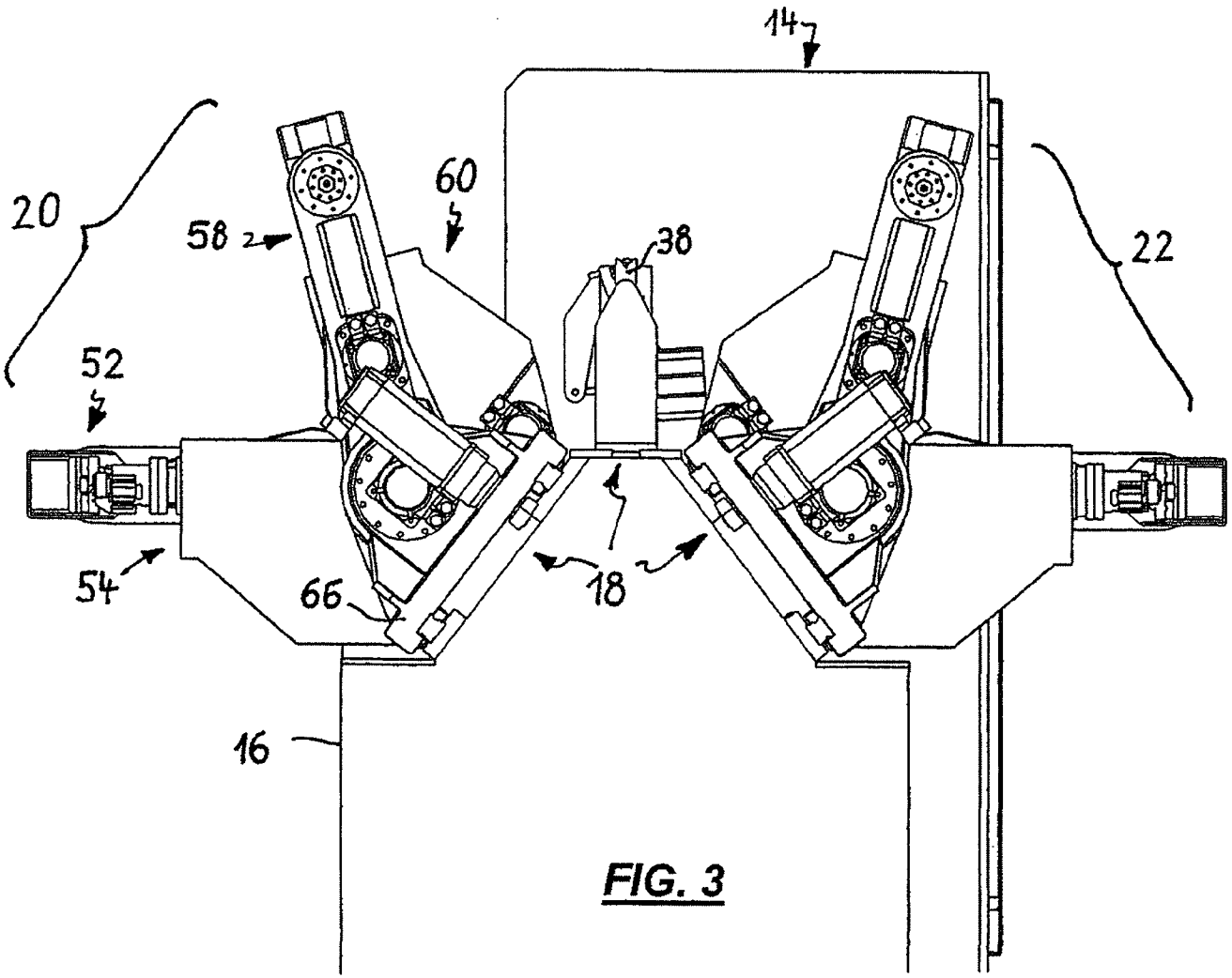
FIG. 3 shows an end view of a bending machine according to FIG. 1 from the machine's end side (viewed in the longitudinal direction of the machine)

It is recognizable in FIGS. 1 and 3—the latter showing a view of the bending machine 10 from the end side thereof (i.e. from the right-hand end in FIG. 1)—that the bending stations 20 and 22 exhibit a mirror-symmetrical arrangement of the individual elements of both bending stations 20, 22 with respect to each other relative to the vertical longitudinal central plane of the machine frame 16.

Figure 5:
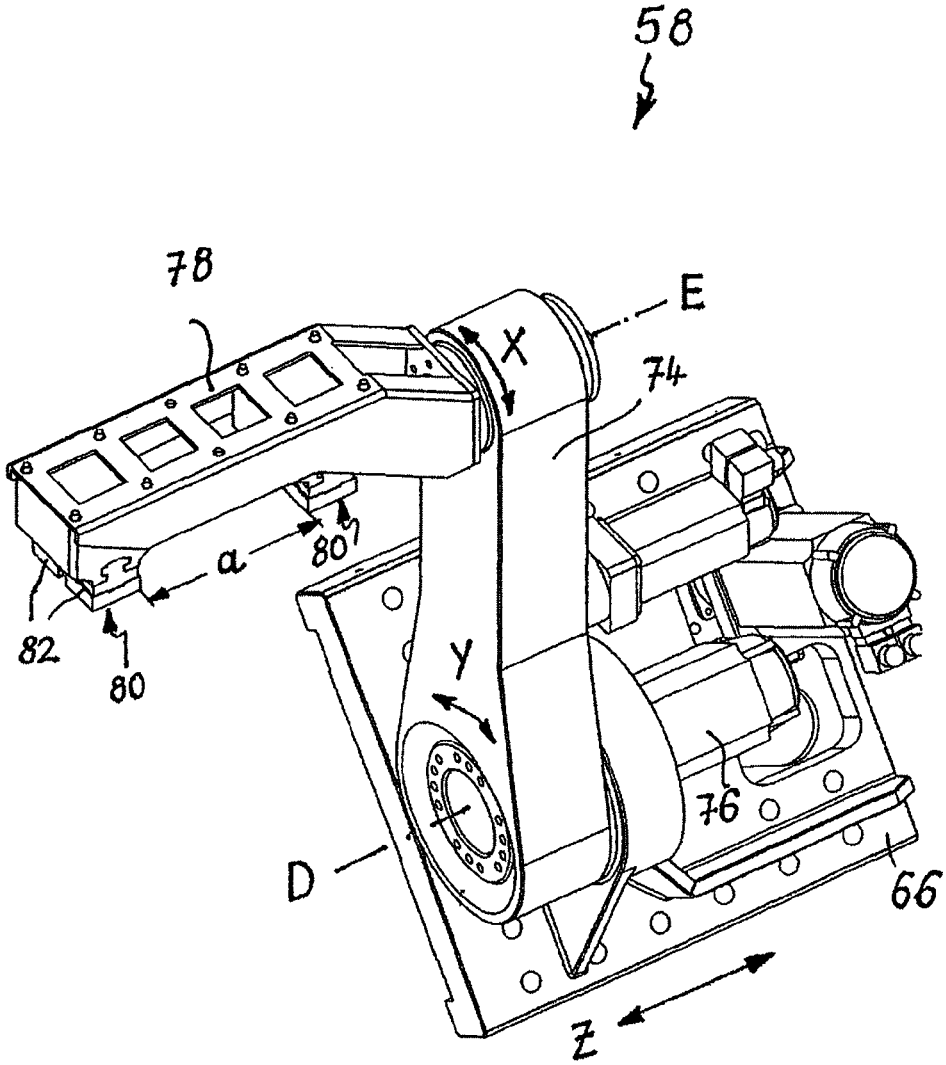
FIG. 5 shows an enlarged perspective view of a gripping unit of the bending machine according to FIG. 1, said unit being mounted to a holding plate.

First of all, however, reference is made to the representation of FIG. 5 which shows the structure of a gripping unit, namely that of the gripping unit 58 of FIG. 1, in an enlarged perspective view.

The gripping unit 58 comprises a lever arm 74 which is pivotable in the direction of rotation Y about an axis of rotation D that is parallel to the direction of displacement Z. The pivoting movement is caused by a motor 76 to which the lever arm 74 is connected.

At its end region facing away from the axis of rotation D, the lever arm 74 supports a gripping arm 78 such that it is pivotable in the direction of rotation X about an axis of rotation E that is parallel to the axis of rotation D of the lever arm 74. The gripping arm 78 which also extends in the direction of the axis of rotation E comprises at its lower surface two gripping arrangements 80, which are spaced apart by a distance a and each of which comprises two clamps 82 that are arranged perpendicular to the axis of rotation E and are mutually displaceable for seizing the workpiece 42, as shown in detail in FIG. 5 to which reference is made.

The gripping unit 58 is fitted on a holding plate 66 which also accommodates the motor 76 as well as other drives required to effect the various movements.

By pivoting the lever arm 74 in the direction of rotation Y, the gripping unit 58 can be pivoted towards the workpiece 42, which has been centrally fed between the two bending stations 20 and 22, in order to seize said workpiece 42 with the gripping arm 78, by means of the two gripping arrangements 80, following which the workpiece 42 can be transferred, by pivoting in the opposite direction, to the region of the bending station 20 in order to effect bending operations there.

However, it is likewise possible that a workpiece 42 already partially bent in the bending station 20 could either be deposited laterally of the machine frame 16 by further pivoting of the gripping unit 58 following the bending operations or, in the case of pivoting in the opposite direction, the workpiece 42 could be transferred, for example, to the opposite bending station 22, picked up there by a gripping unit of that bending station and then subjected there to further shaping by bending.

Thus, the entire assembly of the gripping unit 58 with holding plate 66 comprises two axes of rotation D and E and is displaceable in the direction of Z. However, in special cases of use it could also be convenient to provide the gripping unit 58 such that the gripping arm 78 is in turn rotatable also about a further (third) axis of rotation which passes through the axes of rotation D and E and is perpendicular to said axes of rotation. This makes it possible to transfer a workpiece 42 also in an initial position or in an orientation which is not parallel to the frame's longitudinal axis M-M.

Figure 6:
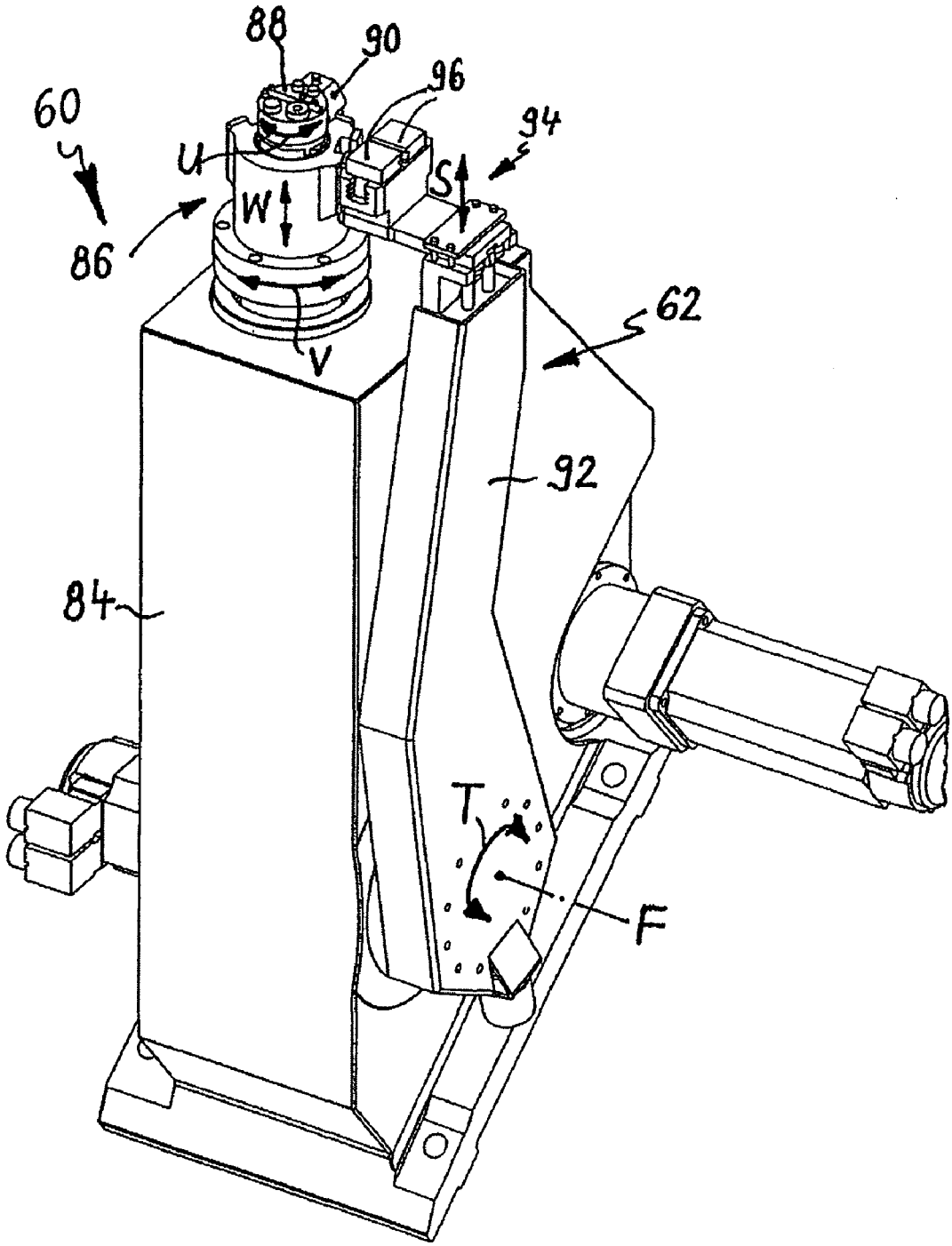
FIG. 6 shows a perspective (enlarged) view of a detail of a bending head with a bending head housing and an auxiliary gripper of the machine according to FIG. 1, said gripper being pivotable on the bending head.

Reference will now be made to the representation of FIG. 6 showing, in an enlarged oblique perspective view (an oblique frontal top view), the construction of a bending head unit with an associated auxiliary gripper, in this case the bending head unit 60 and the auxiliary gripper 62, which cooperate with the gripping unit of FIG. 6 in connection with the first bending unit 44 of the first bending station 20. The bending head unit 60 comprises a bending head housing 84 to which a bending tool 86 is attached which consists of a central bending mandrel 88 that is in turn rotatable in the direction of rotation U and of an associated bending pin 90 that is arranged concentrically to the mandrel 88 and is rotatable in the direction of rotation V.

An auxiliary gripper 62 is mounted to the bending head housing 84 immediately laterally of the latter, said auxiliary gripper 62 being pivotable about a pivoting axis F in a direction of rotation T and consisting of a supporting arm 92, whose end facing away from its pivoting axis F is provided with a gripping arrangement 94 comprising two mutually displaceable clamps 96. The gripping arrangement 94 including the clamps 96 is radially displaceable in the direction S (i.e. in the longitudinal direction of the supporting arm 92) with respect to the pivoting axis F. The pivoting axis F of the supporting arm 92 extends parallel to the frame's longitudinal axis M-M and is located at a point on the side of the bending head housing 84 such that, when the supporting arm 92 is aligned parallel to the axis of rotation of the bending tool 86 (bending mandrel 88 and bending pin 90), the workpiece 42 to be processed and held between the clamps 96 has an orientation that is proper for reception within the bending tool.

Figure 4:
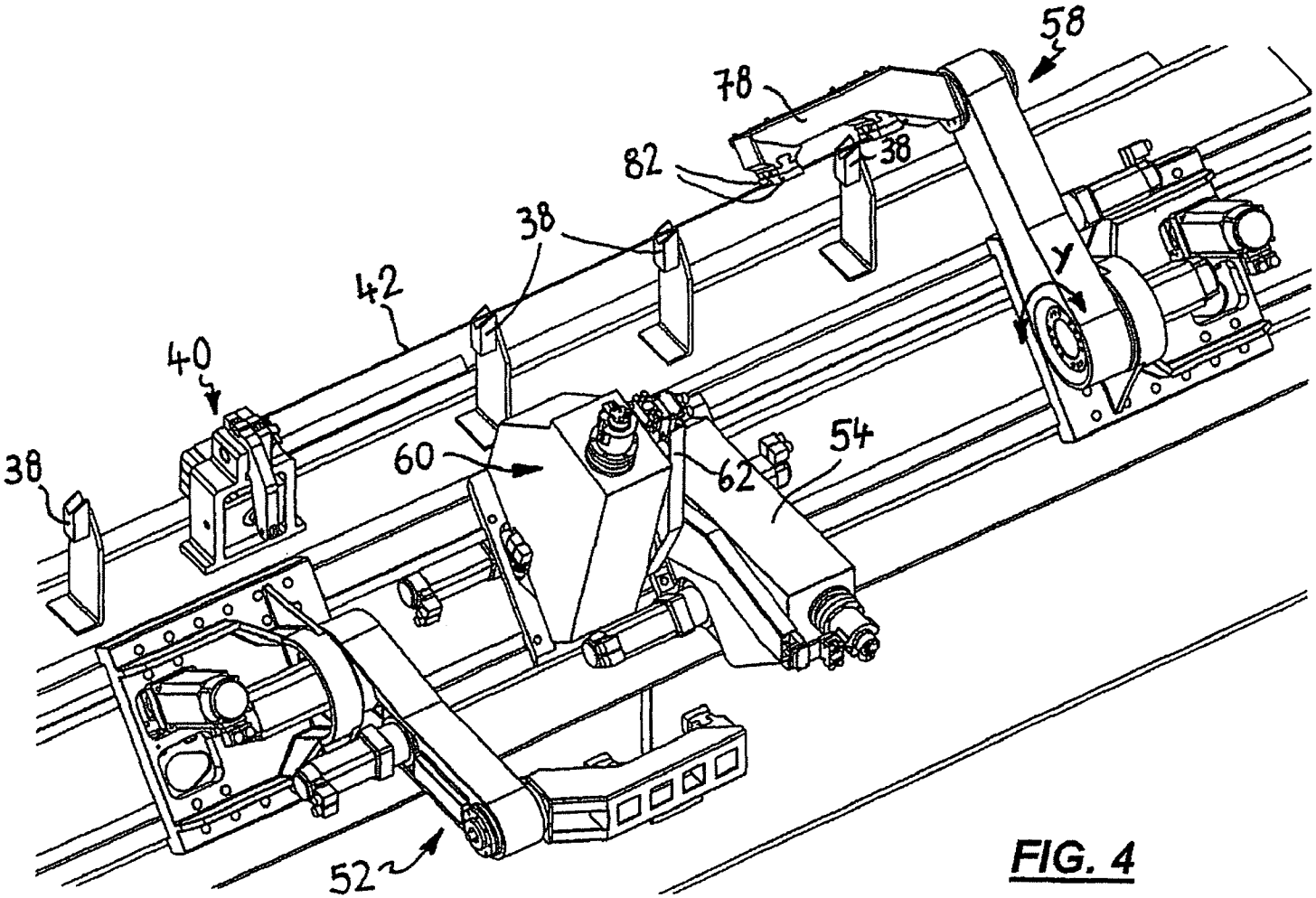
FIG. 4 shows a perspective top view of a bending station of the bending machine according to FIG. 1.

FIG. 4 shows an oblique perspective view of a portion of the bending machine 10 which substantially comprises the bending station 20.

FIG. 4 shows the condition of the machine in which the feed wire has just been cut by the cutting module 40 (the wire arranged preceding the cutting module 40 in the infeed direction has been omitted), thereby producing a workpiece 42 cut to length (in this case, a wire section having a predetermined length), which is initially held by various guide elements 38 arranged with an offset in the longitudinal direction.

The gripping unit 58 has now been pivoted such that the clamps 82 at the bottom surface of the gripping arm 78 can seize the elongated workpiece 42 at its front end region at two mutually offset points and transfer it to the processing zone of the bending station 20 by pivoting in the direction Y. If required or desired, the auxiliary gripper 62 of the bending head unit 60 cooperating with the gripping unit 58 may also be pivoted towards the workpiece 42, which can additionally be seized also by the clamps 96 of said auxiliary gripper 62 at a further point and then transferred to the bending station 20 together with the gripping unit 58 by being pivoted back.

As is also clearly shown in FIG. 4, the bending head units 54 and 60 of the first bending station 20, which are both securely fixed to the guide rails 68, 70 of the machine bed 18, have different orientations with respect to each other so that their bending tools have bending axes that are inclined towards each other.

The bending machine 10 shown in the Figures operates in the manner described below, shown with reference to a continuously fed wire 12:

As FIG. 1 shows, the wire 12 is drawn from a coil (not shown) through the infeed module 24 via the infeed rollers 26 and is fed to the straightening module 28. The further infeed module 30 arranged following the straightening module 28 pulls the wire 12, just straightened, out of the straightening module 28 and feeds it via the further pair of infeed rollers 32 to the subsequently arranged length-measuring unit 34. From the length-measuring unit 34, the wire 12 is further fed to the cutting and guiding unit 36. As soon as the desired length of wire has been detected by the length-measuring unit 34, the infeed modules 24 and 30 are stopped, and the cutting module 40 is actuated, thereby producing a workpiece 42 cut to length, as shown in FIG. 4.

Displacing the holding plate 66 of the gripping unit 58 in the Z direction and pivoting the lever arm 74 and the gripping arm 78 about their respective pivoting axes D and E allows the gripping arrangements 80 on the gripping arm 78 to be moved into the path of the cut-to-length workpiece 42 supported on the guiding elements 38 (cf. FIG. 4) and allows the workpiece 42 to be seized at its end region there (cf. FIG. 4). If a long workpiece 42 is to be processed—as already outlined above—the auxiliary gripper 62, which cooperates with the gripping unit 58 and is provided at the bending head unit 60, may also be pivoted towards the workpiece 42 and likewise seize the latter by the clamps 96 of the auxiliary gripper 62 so as to prevent, for example, the workpiece 42 beginning to vibrate when pivoting back to the bending head unit 60 of the bending unit 46.

The gripping unit 58 and the auxiliary gripper 62 then pivot the workpiece 42 into the region of the bending head unit 60.

As a result of the bending tools' movements in the directions U, V and W as well as due to the movement of the holding plate 66 in the Z direction and of the gripping unit 58 about the pivoting axes D and E, one side of the cut-to-length workpiece 42 can be provided with bends in different planes.

In order to enable processing of the other side of the workpiece 42, the gripping unit 52 and the auxiliary gripper 56 of the other bending unit 44 then pivot towards the bending head unit 60, where they pick up the previously bent workpiece 42, following which they pivot the latter towards the bending head unit 54. There, the second portion of the workpiece 42 is then bent and, as soon as bending of the workpiece 42 is completed, the workpiece 42 can then be deposited laterally of the bending machine 10, e.g. on a conveyor belt or the like, by the gripping unit 52.

After the workpiece 42 has been transferred from the bending unit 46 to the other bending unit 44, a new workpiece 42 can be fed to the bending unit 46.

During processing of a workpiece 42 in the bending unit 46, the infeed modules 24 and 30 are actuated again, and a second workpiece 42 cut to length is produced. This workpiece is then processed in the opposite second bending station 22, for which purpose the gripping unit arranged there opposite the gripping unit 58 picks up this second workpiece 42 and pivots it into the bending zone of the bending head unit located opposite the bending head unit 60.

The infeed and straightening unit 14 then alternately feeds the first bending station 20 (front) and the second bending station 22 (rear), the workpiece 42 being bent in both bending stations first in the bending unit 46 or 50, respectively, and then in the bending unit 44 or 48, respectively.

The construction of the bending machine 10 enables its extremely flexible use:

For instance, similar workpieces can be bent in the bending stations 20, 22, which provides for almost double the production capacity as compared to a simple machine. It is also possible to produce different parts on both sides of the machine in both bending stations 20, 22 and also from wire sections having different lengths.

The bending machine 10 can also be operated without the infeed and straightening unit 14, e.g. if cut-to-length workpieces are provided in a magazine. In this case, processing would be effected in a serial manner and the respective workpiece 42 would be shaped in up to four processing stations (bending units). A transfer from the first bending station 20 to the second bending station 22 is possible without any difficulty using the gripping units 52 and 58.

It is also possible to arrange a plurality of bending stations behind each other on either side of the bending machine 10 so that, accordingly, more than four bending units are realized on either side. The gripping unit 58 is designed such that a transfer to a further bending machine (not shown in the Figures) placed next to the bending machine 10 could be effected.

All processes of the entire machine are conventionally controlled by a central program control (not shown in the Figures).

The gripping arms of all gripping units 52, 58 etc. are preferably pivotable through 360°, whereas the lever arms of the gripping units 52, 58 etc. as well as the supporting arms of the auxiliary grippers 56, 62 etc. are pivotable through 180°.

The bending head housings 84, etc. of the individual bending head units 60, etc. comprise the drive for the bending pins, the drive for the bending mandrels as well as the drive for displacing the actual bending head (bending tool) in the direction W.

The invention claimed is:

1. A bending machine for bending rod-shaped workpieces made from wire or tubular material comprising:

a machine frame provided with at least one bending station comprising two bending units;

wherein each of said bending units comprises a bending head with a bending head housing and a bending tool, an auxiliary gripper arranged on the bending head housing so as to be pivotable perpendicular to the longitudinal axis of the machine frame, and a gripping unit spaced apart from the bending head as viewed along the longitudinal axis of the machine frame that is pivotable perpendicular to the longitudinal axis of the machine frame and displaceable on a guide in the direction of the longitudinal axis; and wherein the two bending heads of each bending station are arranged next to each other with their auxiliary grippers facing each other and are positioned between the two gripping units such that each bending head, when viewed in the direction of the machine frame's longitudinal axis, is mounted between the other bending head and the gripping unit associated with the other bending head.

2. The bending machine of claim 1, wherein both gripping units of the bending station are displaceable along the same guide.

3. The bending machine of claim 1, wherein each guide for the gripping units consists of two guide rails on the machine frame which are parallel to one another as well as to the frame's longitudinal axis.

4. The bending machine of claim 1, wherein each auxiliary gripper comprises a supporting arm which is pivotally supported immediately laterally of the bending head housing of the associated bending head.

5. The bending machine of claim 4, wherein the supporting arm comprises, at a protruding end, a gripping arrangement that is radially displaceable with respect to a pivoting axis and is provided with two clamps for gripping a rod-shaped workpiece to be fed to the bending tool for bending.

6. The bending machine of claim 1, wherein one bending station is provided on each side of the frame's longitudinal axis.

7. The bending machine of claim 6, wherein the two bending stations have an identical design.

8. The bending machine of claim 1, wherein each gripping unit comprises a pivotable lever arm having, at an end region facing away from a pivoting axis of the lever arm, a gripping arm mounted so as to be pivotable about a further pivoting axis and comprising two gripping arrangements, spaced apart by a distance in the longitudinal direction of the machine frame's longitudinal axis, for seizing a rod-shaped workpiece.

9. The bending machine of claim 8, wherein the pivoting axis of the lever arm and the pivoting axis of the gripping arm of each gripping unit are parallel to one another.

10. The bending machine of claim 1, wherein each gripping unit, together with an associated drive, is accommodated on a holding plate which is arranged so as to be displaceable along the guide on the machine frame.

11. The bending machine of claim 1, further comprising an infeed and straightening unit preceding the machine frame, by means of which a wire or a tube can be fed centrally between two bending stations and parallel to the frame's longitudinal axis.

12. The bending machine of claim 11, further comprising a cutting unit for cutting off the fed wire, wire or tube at a point preceding its entrance between the bending stations.

13. The bending machine of claim 1, further comprising a magazine for containing rod-shaped workpieces from which the individual rod-shaped workpieces can be taken by the gripping unit and by the auxiliary gripper of a laterally arranged bending unit for processing by the bending machine.

14. The bending machine of claim 1, wherein each bending head housing of each bending head is securely attached to the machine frame and each bending tool is displaceable with respect to its respective bending head housing.

15. The bending machine of claim 1, wherein the machine frame comprises a machine bed at an upper portion of the machine frame having a cross-section substantially the shape of an isosceles trapezoid.

16. The bending machine of claim 15, wherein the at least one bending station is provided on an oblique side of the machine bed.

17. The bending machine of claim 16, further comprising a second bending station provided on the other oblique side of the machine bed.

18. The bending machine of claim 1, wherein the gripping units are each displaceable via a rack-and-pinion drive along the guides.

19. The bending machine of claim 1, wherein the two bending units of the bending station have an identical design.

20. The bending machine of claim 1, wherein two or more bending stations are provided on one or both sides of the frame's longitudinal axis.

21. A bending machine for bending rod-shaped workpieces made from wire or tubular material comprising:

a machine frame comprising a machine bed at an upper portion of the machine frame having a cross-section substantially the shape of an isosceles trapezoid;

first and second bending stations provides on oblique sides of the machine bed located on opposite sides of a longitudinal axis of the machine frame; and two bending units comprising each bending station, each bending unit comprising:

a bending head with a bending head housing and a bending tool;

an auxiliary gripper comprising a supporting arm which is pivotally supported immediately laterally of the bending head housing of the associated bending head and arranged on the bending head housing so as to be pivotable perpendicular to the longitudinal axis of the machine frame, wherein the supporting arm comprises, at a protruding end, a gripping arrangement that is radially displaceable with respect to a pivoting axis and is provided with two clamps for gripping a rod-shaped workpiece to be fed to the bending tool for bending; and a gripping unit comprising a pivotable lever arm having, at an end region facing away from a pivoting axis of the lever arm, a gripping arm mounted so as to be pivotable about a further pivoting axis and comprising two gripping arrangements, spaced apart by a distance in the longitudinal direction of the machine frame's longitudinal axis, for seizing a rod-shaped workpiece, the gripping unit spaced apart from the bending head as viewed along the longitudinal axis of the machine frame and displaceable on a guide in the direction of the longitudinal axis;

wherein the two bending heads of each bending station are arranged next to each other with their auxiliary grippers facing each other and are positioned between the two gripping units such that each bending head, when viewed in the direction of the machine frame's longitudinal axis, is mounted between the other bending head and the gripping unit associated with the other bending head.

22. A method of bending rod-shaped workpieces made from wire or tubular material the method comprising the steps of:

providing a machine frame with at least one bending station comprising first and second bending units;

providing a rod-shaped workpiece along a longitudinal axis of the machine frame;

gripping the workpiece with a gripping unit of the first bending unit;

pivoting the gripping unit of the first bending unit to move the workpiece towards a bending head of the first bending unit;

bending the workpiece with the gripping unit and a bending tool of the first bending unit;

gripping the workpiece with a gripping unit of the second bending unit;

pivoting the gripping unit of the second bending unit to move the workpiece towards a bending head of the second bending unit; and bending the workpiece with the gripping unit and a bending tool of the second bending unit;

wherein the two bending heads of each bending station are arranged next to each other between the two gripping units such that each bending head, when viewed in the direction of the machine frame's longitudinal axis, is mounted between the other bending head and the gripping unit associated with the other bending head.

* * * * *